United States Patent [19]

Brandner et al.

[11] Patent Number: 4,738,237

[45] Date of Patent: Apr. 19, 1988

[54] IDLING CONTROL FOR AN OTTO ENGINE

[75] Inventors: Burkhard Brandner, Werdohl; Bernhard Klein, Neschen; Albert Stübs, Lüdenscheid; Helmut Schilly, Bergneustadt, all of Fed. Rep. of Germany

[73] Assignee: Atlas Fahrzeugtechnik GmbH, Werdohl, Fed. Rep. of Germany

[21] Appl. No.: 947,900

[22] Filed: Dec. 30, 1986

Related U.S. Application Data

[63] Continuation-in-part of Ser. No. 659,429, Oct. 10, 1984, abandoned.

[30] Foreign Application Priority Data

Oct. 13, 1983 [DE] Fed. Rep. of Germany ..... 3337260

[51] Int. Cl.[4] ..... F02D 41/08; F02M 3/07

[52] U.S. Cl. ..... 123/339; 123/360; 251/129.1

[58] Field of Search ..... 123/339, 360; 137/625.65; 251/129.1, 129.16

[56] References Cited

U.S. PATENT DOCUMENTS

| | | | |
|---|---|---|---|
| 2,983,278 | 5/1961 | Heintz | 251/137 |
| 3,289,905 | 12/1966 | Pitt et al. | 251/129.1 |
| 3,460,573 | 8/1969 | Beveridge et al. | 251/137 |
| 3,722,614 | 3/1973 | Sakakibara et al. | 123/353 |
| 4,005,733 | 2/1977 | Riddel | 137/625.65 |
| 4,154,198 | 5/1979 | Hoshi | 123/490 |
| 4,401,075 | 8/1983 | O'Keefe, Jr. et al. | 123/353 X |
| 4,402,376 | 9/1983 | Hayashi et al. | 123/360 X |
| 4,471,735 | 9/1984 | Collonia | 123/339 |
| 4,474,153 | 10/1984 | Hanamoto et al. | 123/339 |

*Primary Examiner*—Tony M. Argenbright

*Attorney, Agent, or Firm*—Schwartz, Jeffery, Schwaab, Mack, Blumenthal & Evans

[57] ABSTRACT

An idling control for an Otto engine comprises a throttle valve positioned in a suction pipe of an engine intake manifold; a pneumatic cylinder unit operably engaged with said throttle valve by means of a positioning leg; a three-way flow control valve in fluid communication with said pneumatic cylinder unit, said valve having respective input conduits for atmospheric pressure and vacuum, and having means for alternatively transmitting said atmospheric pressure and said vacuum to said pneumatic cylinder unit, said transmitting means including opposing coils and a pulse generator having an adjustable pulse duty factor, said coils being connected to push-pull outputs of said pulse generator, the alternative positions of said control valve being determined in accordance with said duty factor, said duty factor being applied to said opposing coils simultaneously; said three-way flow control valve further includes valve seats for said input conduits and a membrane-like, freely-movable ferromagnetic valve plate having non-magnetic surface layers cooperable with said valve seats; and means for adjusting said pulse duty factor in accordance with engine operating parameters.

12 Claims, 2 Drawing Sheets

IDLING CONTROL FOR AN OTTO ENGINE

CROSS-REFERENCE

This application is a continuation-in-part application of Ser. No. 659,429, filed Oct. 10, 1984, now abandoned.

BACKGROUND OF THE INVENTION

1. FIELD OF THE INVENTION

The invention relates to an idling control for an Otto engine.

2. DESCRIPTION OF THE PRIOR ART

In order that an Otto engine running idle can take up load variations and does not stop a comparatively overrich fuel-air mixture is fed to an Otto engine. An increased production of noxious substances and, thus, environmental problems are caused. It is necessary to set the idling speed itself comparatively high. In spite of this, difficulties occur, if the motor vehicle comprises power steering or an air-conditioning system and if thereby load variations occure when running idle.

The DE-OS 33 16 660 describes an idling control of the above mentioned kind. The throttle valve can be adjusted from a stop position which corresponds to the idling nominal speed in order to keep the idling actual speed on the nominal value in case of decrease. If the actual idling speed is too high, it is possible to influence the speed of the Otto engine. The control of the throttle valve is effected in the periodically a change-over voltage is supplied to the three-way flow control valve so that an increased extent of a vacuum is applied to the cylinder unit. By this obviously a stable control cannot be guaranteed so that periodical variations of the idling speed occur.

The DE-PS 29 48 151 describes an idling adjustment, which excludes a decrease of the engine speed under the nominal idling speed. The control is carried out by means of a magnetic valve which causes the suction pipe vacuum in a positioning valve to become operative. Also in this case a stable adjustment is scarely possible.

SUMMARY OF THE INVENTION

In the following nominal speed and actual speed always mean idling nominal speed and idling actual speed.

One object of the invention is an adjustment of the idling speed on the basis of a compensation of load variations.

In accordance with the present invention an idling control for an Otto engine comprises:

- a throttle valve positioned in a suction pipe of an engine intake manifold;
- a pneumatic cylinder unit operably engaged with said throttle valve by means of a positioning leg;
- a three-way flow control valve in fluid communication with said pneumatic cylinder unit, said valve having respective input conduits for atmospheric pressure and vacuum, and having means for alternatively transmitting said atmospheric pressure and said vacuum to said pneumatic cylinder unit, said transmitting means including opposing coils and a pulse generator having an adjustable pulse duty factor, said coils being connected to push-pull outputs of said pulse generator, the alternative positions of said control valve being determined in accordance with said duty factor, said duty factor being applied to said opposing coils simultaneously;
- said three-way flow control valve further includes valve seats for said input conduits and a membrane-like, freely-movable ferromagnetic valve plate having non-magnetic surface layers cooperable with said valve seats; and
- means for adjusting said pulse duty factor in accordance with engine operating parameters.

The invention differs from the prior art in that the throttle valve adjustment is adjusted when running idle so that speed variations above and below the nominal speed can be excluded. By this always the most favourable fuel mixture quantity can be sucked in. The production of noxious substances is reduced. By the described adjustment of the throttle valve, the actual speed is maintained on the nominal speed when running idle. The invention provides for the control of the throttle valve the utilization of the suction pipe vacuum via a three-way flow control valve. This three-way flow control valve is precisely controlled by a pulse generator with adjustable pulse duty factor of pulse width to pulse space. Thus the three-way flow control valve allows a very precise control of the flow and consequently of the positioning pressure in the cylinder unit for the setting of the throttle valve. This pulse duty factor can be adjusted continuously between 0% and 100%. The valve plate is moved to-and-fro by each pulse between the valve seats opposing each other, the closing time on the valve seats being determined by the pulse duty factor. This means that each valve seat is closed or opened during a time portion corresponding to the pulse duty factor. Thereby the flow can be controlled precisely, not influenced by characteristics of the flow control valve. In addition to control of the idling speed is effected also as a function of parameters so that the idling speed can be adapted to different operating conditions of the engine. The non-magnetic layers of the valve plate allow very short switching times for the valve, so that the duty factor can be varied within a large range.

The invention is applicable to all Otto engines which comprise a suction pipe with a throttle valve. These Otto engines may be equipped with a carburetor or with an injection device. Due to the fact that the idling adjustment influences merely the setting of the throttle valve, the remaining components for the mixture preparation are optional.

In order to reduce the loading of the valve coils it is provided that each pulse comprises a large switch current of short duration and a following small holding current. After the switching over of the valve plate by the large switching current the coil current is reduced to a small holding current. Thereby the loading of the coils is reduced considerably. Therefore the mean current for the coils can be reduced so that the coils can be minimized in capacity.

An other object of the invention is provided wherein said means for adjusting said pulse duty factor includes a comparing circuit for comparing a nominal speed with an actual speed of the engine, and delivering a shifting signal for the pulse duty factor to said pulse generator.

According to another object of the invention the idling circuit further includes a duty factor adjustment circuit for shifting said pulse duty factor.

An exact setting of the throttle valve is effected in that said pneumatic cylinder unit includes a membrane valve and a restoring spring. Therefore, the vacuum acts against the force of the restoring spring, the effective portion of the vacuum being determined by the adjustment of the pulse duty factor.

The influence of different parameters is rendered possible by including means for modifying said nominal speed as a function of engine operating parameters.

According to another object of the invention are included means for modifying said nominal speed as a function of engine operating parameters.

In order that in case of a cold engine the idling speed has a higher value, it is further included a temperature feeler operatively connected to said modifying circuit, said temperature feeler sensing the temperature of said engine and causing said modifying circuit to increase said modified nominal speed when said engine is cold. With increasing operating temperature of the Otto engine the temperature feeler delivers a signal on the basic value so that accordingly the modified nominal speed is decreased to the nominal speed for the idle running. Thus the idling control according to the present invention is also effective as automatic choke control so that a separate automatic choke control is not necessary.

In the case of delay operations, particularly in the case of sudden closing of the throttle valve, the engine speed shall be reduced just gradually to the idling speed to keep the emission of noxious substances low. For this the invention further includes delay means for increasing said nominal speed when the actual speed of said engine suddenly decreases, said delay means then gradually decreasing said increased nominal speed and thereby gradually decreasing said actual speed of said engine.

This modifying signal can be deduced appropriately directly from the actual speed signal in that said delay means includes a differentiating circuit which outputs an increased nominal speed to said modifying circuit.

A further object of the invention is provided, wherein said increased nominal speed is calculated by said differentiating circuit directly from an actual engine speed signal.

In order to influence the time duration in which the engine speed is decreased to the idling nominal speed, it is provided that said delay means further includes a time function circuit connected to said differentiating circuit, said time function circuit delaying the output of said increased nominal speed from said differentiating circuit to said modifying circuit. Thereby the engine speed can be brought gradually to the idling value in case of sudden slipping from the gas pedal.

A further object of the invention is provided, wherein at least one of said input conduits is in fluid communication with said pneumatic cylinder unit at all times.

BRIEF DESCRIPTION OF THE DRAWINGS

One embodiment of the invention will be described in the following with reference to the accompanying drawings, wherein.

DESCRIPTION OF THE PREFERRED EMBODIMENT

Figures 1, 2, 3:
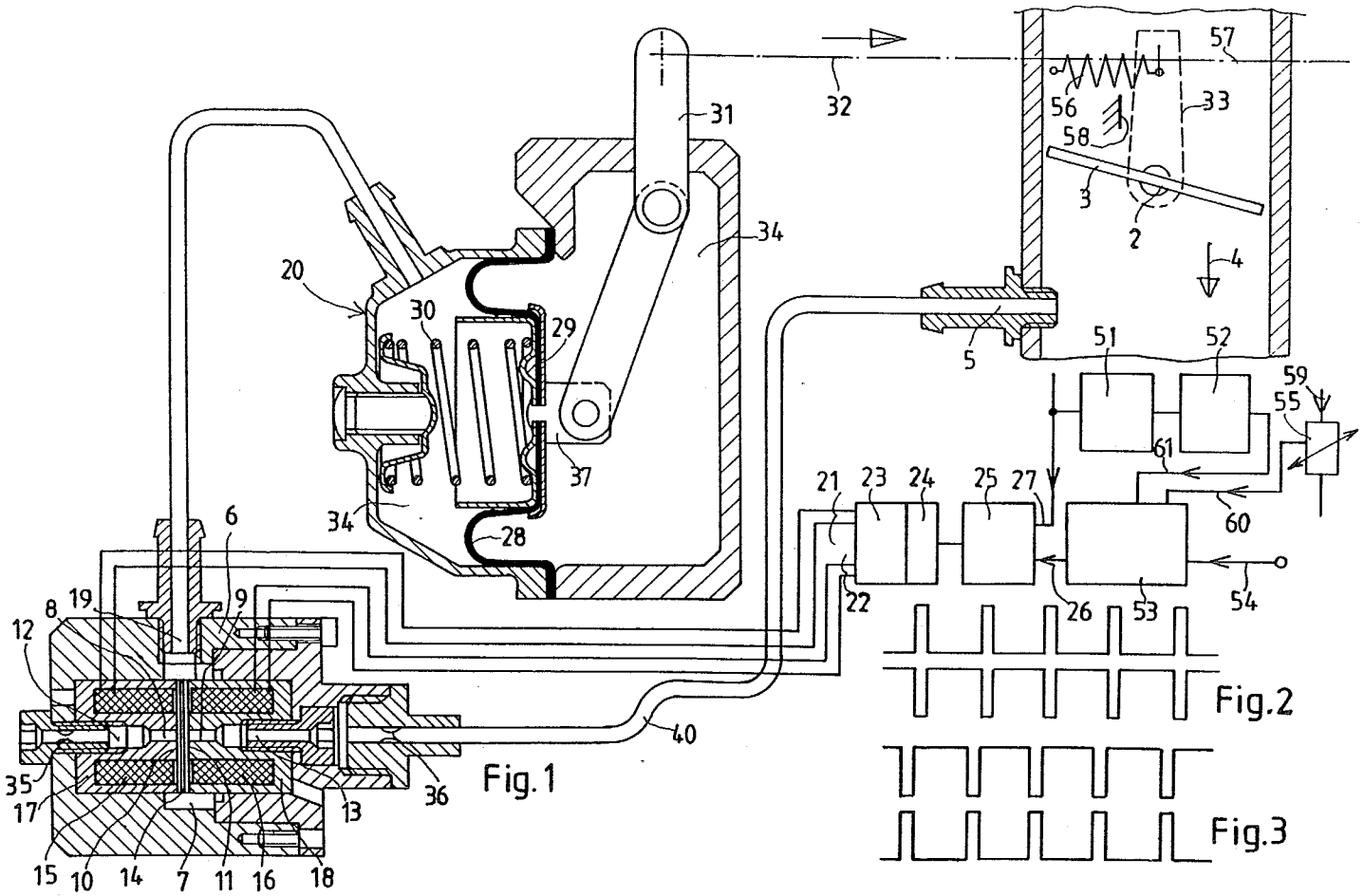
FIG. 1 is a schematical view of the idling control in connection with the suction pipe of an Otto engine.
FIG. 2 is a pulse diagram for one limit of the pulse duty factor.
FIG. 3 shows a pulse diagram for the opposite limit of the pulse duty factor.

FIG. 1 shows a suction pipe 1 of an Otto engine, which receives a throttle valve 3, pivotable by means of a positioning leg 33 on a shaft 2 against the action of a restoring spring 56. For the closing position of the throttle valve 3 a limit stop 58 is provided. The throttle valve 3 is normally operated by a pulling element 57, which is coupled to a gas pedal, not shown. In addition, a linkage 32 acts upon the positioning leg 33 which linkage however is effective only in the idling position of the pulling element 57 and as for the rest does not impede the pulling element 57. The connection of these operating elements is not shown in detail. A carburetor or an injection device may be associated with the suction pipe 1. In FIG. 1 the flow direction 4 of the air sucked in or of the fuel-air mixture, respectively, is indicated. On a nozzle 5 the full vacuum of the suction pipe 1 is present and may be tapped off there via a line 40.

Figure 4:
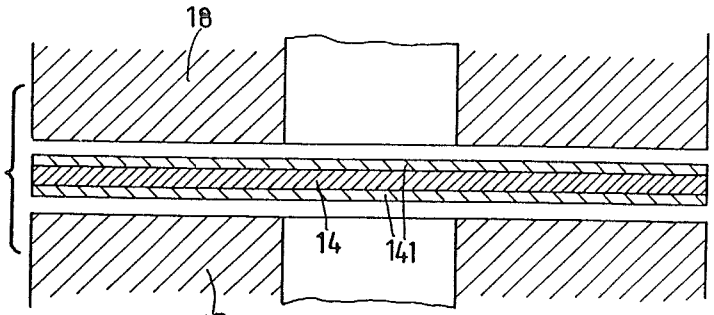
FIG. 4 is a section of a valve plate in an enlarged scale.

The invention provides a three-way flow control valve 6. Same comprises within a valve chamber 7 two input channels 8 and 9 opposing each other with valve seats 10 and 11 which are assigned to input conduits 12 and 13. Within the valve chamber 7 a freely movable, membrane-like, ferromagnetic valve plate 14 is arranged, which alternately cooperates with the valve seats 10 and 11. Said valve plate 14 is made of soft iron. Both surfaces have layers 141 of a non-magnetic material as chromium, see FIG. 4. Coils 15, 16 which are wound on a pot magnet 17, 18, respectively, are arranged oppositely the valve plate 14. The specific core of each pot magnet 17, 18 also surrounds one of the input channels 8, 9. An output conduit 19 which leads to a pneumatic cylinder unit 20 ends in the valve chamber 7.

The coils 15, 16 are connected to push-pull outputs 21, 22 of a pulse generator with adjustable pulse duty factor. The pulse generator 23 operates with a pulse frequency up to 1 kHz. The pulse duty factor as the ratio between pulse duration and pulse space of the pulse generator 23 can be adjusted by a pulse duty adjusting circuit 24 from 0 to 100%. The pulse duty adjusting circuit 24 is controlled by the difference of shifting signal of a comparing circuit 25. An input 26 is applied by a modified nominal speed signal for the idling speed which signal is modified for determined operational conditions in regard to the nominal speed signal; this will be explained in more detail in the following. An actual speed signal which indicates the actual speed of the crankshaft of the Otto engine is on the other input 27. The difference or shifting signal serves for the adjustment of the pulse duty factor via the pulse duty adjusting circuit 24; that will be explained in more detail in the following.

Figure 6:
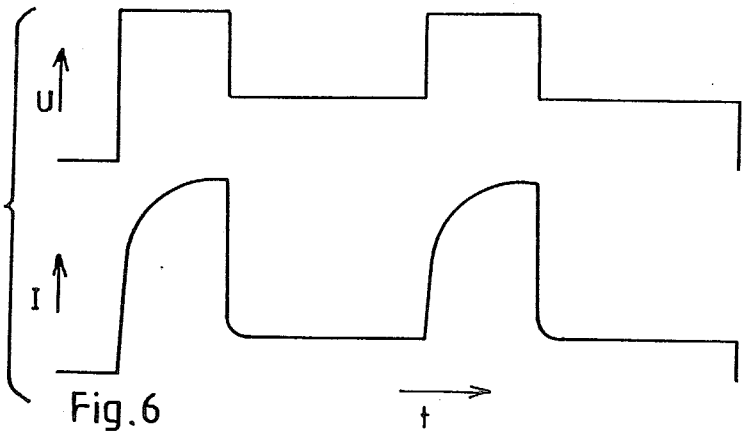
FIG. 6 shows a pulse diagram.
Figure 5:
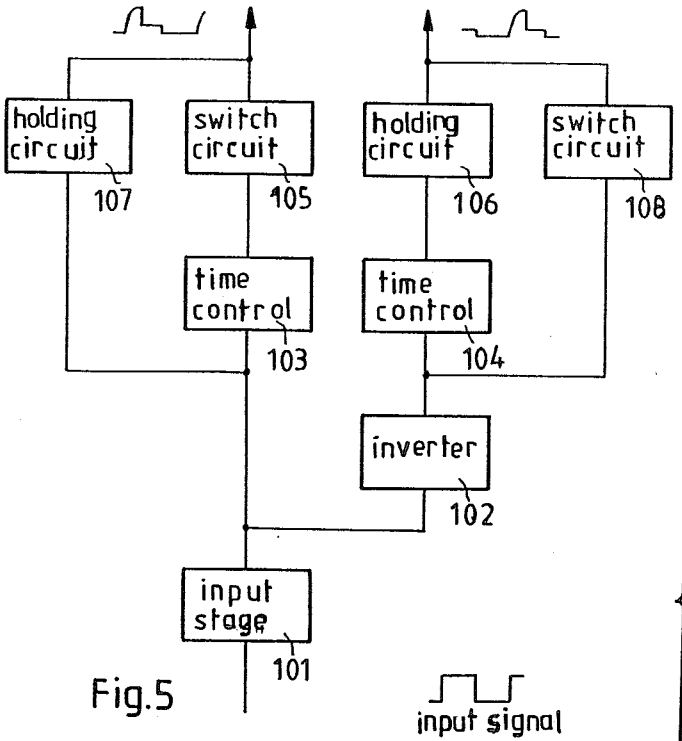
FIG. 5 is a block diagram of the end stages of the pulse generator.

FIG. 5 shows the end stages of the pulse generator 23. An input signal with a controlled duty factor is fed into the input stage 101. The output signal is branched in two push-pull branches, one branch is coupled via an inverter 102. Each branch comprises a time control stage 102, 104, a switch current circuit 105, 106 and a holding current circuit 107, 108. The time control stages 103 or 104 produce a time pulse of a partial duration e.g. 10 percent of the total pulse duration. The switch current circuits effects a large switch current during said partial duration. Said large switch current for attracting the valve plate is effective a short time only. A small holding current produced by the folding current circuit 107 or 108 follows. Said small holding current reduces the loading of the coils. The curves for the voltage and the current are shown in FIG. 6.

The cylinder unit 20 contains a membrane 28, closing a cylinder chamber 34, a piston 29 with a piston rod 37 as well as a pressure spring 30. The piston rod 37 is coupled with a pivotable supported positioning lever 31, which is coupled with the linkage 32.

The three-way flow control valve 6 is connected in detail as follows. The cylinder chamber 34 is connected with the output conduit 19. The line 40 leads to the input conduit 13 with the restrictor 36. The input conduit 12 opens into the atmosphere and comprises a restrictor 35. The flow cross-sections of the restrictors 35 and 36 are smaller than the flow cross-section of the flow control valve 6 so that changes of the flow cross-section of the flow control valve, particularly wear of the valve seats 10 and 11, do not show a detrimental effect to the adjusting behavior. Since the valve plate 14 is in contact with any of the valve seats 10 or 11, one of the input conduits 12 or 13 is in fluid connection with the output conduit 19 and the pneumatic cylinder unit 20 at all times.

The input 26 of the comparing circuit 25 is coupled to a modifying circuit 53, to which on the one side a nominal speed signal 54 is given. On the other side via the lines 60 and 61 modifying signals are applied which modify the nominal speed signal 54 so that on the input 26 a nominal speed signal 54 is applied.

The line 60 comes from a temperature feeler 55, which is installed in a cooling water line 59 of the Otto engine and measures the temperature of the cooling water. Also any other measuring of the engine temperature is possible.

The actual speed signal on the line 27 is differentiated in a differentiating circuit 51. Then the differentiating circuit 51 delivers an output signal, if the engine speed decreases suddenly. That is the case in the sudden slipping from the gas pedal. The output signal of the differentiating circuit 51 is applied on a time function circuit 52, which delivers after the responding to the output signal of the differentiating circuit 51 a voltage signal, gradually falling to the basic value, on the line 61 to the modifying circuit 53. Thereby an increase of the modified nominal speed signal is effected on the input 26 so that the speed adjusts just gradually to the idling nominal speed according to the modified nominal speed signal. Thereby sudden delays of the engine speed are avoided. The emission of noxious substances is reduced.

The control behavior of the idling adjustment will be described firstly for the case of an engine under hot running conditions. The unmodified nominal speed signal is applied on the input 26 of the comparing circuit 25. The nominal speed has a normal value of 500 revolutions per minute. Other settings are also possible. An actual speed signal is applied on the line 27, which signal indicates the actual speed of the crankshaft. In the comparing circuit 25 a difference signal is formed as a shifting signal. As long as the actual speed is higher than the nominal speed on the output of the comparing circuit 25 a shifting signal of one polarity is delivered to the pulse duty adjusting circuit 24 which results in a reduction of the pulse duty factor of the pulse generator 23, in the case of the illustration of FIG. 2 approximately 0%. The upper curve shows the short pulses with long pulse space on the output 21 for the coil 15. The push-pull output 22 and, thus, the coil 16 show a pulse shape according to the lower half of FIG. 2, namely short pulse spaces and long pulse durations. This pulse shape effects that the valve plate 14 fits on the valve seat almost permanently. Consequently, the input conduit 13 is closed so that substantially atmospheric pressure exists in the cylinder chamber 34. Consequently, the piston 29 of the cylinder unit 20 is moved to the right, related to FIG. 1, so that the throttle valve reduces the suction pipe cross-section. The engine speed decreases, until the nominal speed is reached. Then the shifting signal disappears so that the output signal of the pulse duty adjusting circuit 24 does not change any more. Consequently, there is not a further change of speed.

If then due to a change of load the idling speed decreases, then the actual speed signal on the line 27 becomes smaller than the nominal speed signal on the line 26. Now the comparing circuit 25 delivers an output signal of opposite polarity to the pulse duty adjusting circuit 24 so that the same effects a higher pulse duty factor of the pulse generator 23.

FIG. 3 shows in the upper half the pulse diagram for a pulse duty factor of almost 100% on the output 22. The coil control by these pulses means that the valve plate 14 fits on the valve seat 10 almost permanently end, consequently, the suction pipe vacuum in the cylinder chamber 34 is effective. Consequently by the suction pipe vacuum the piston 9, related to FIG. 1, is moved to the left. Thereby the positioning leg 33 with the throttle valve 3 is swivelled clockwise so that the throttle valve 3 is opened. Therefore, the engine is able to suck in a larger mixture quantity so that accordingly the speed increases. This influence continues, until the actual speed reaches the nominal speed valve again.

The pulse duty factor may be controlled continuously between 0% and 100% and may be adjusted to any value. Each setting corresponds to a stable positioning of the throttle valve. The higher switching current over the holding current is not shown in FIG. 2 and 3 in detail.

For the removal of short-time hunting the restrictors 35 and 36 in the input conduits 12 and 13 are provided. These restrictors limit the alteration velocity of the speed.

Via the modifying circuit 53 the nominal speed signal can be altered, as described above. Then one obtains an increased idling speed during the running up phase or during a decelerating phase.

The non-magnetic layers 141 reduce the switching time of the valve plate considrably.

We claim the following:

1. An idling control for an Otto engine, comprising:
   - a throttle valve positioned in a suction pipe of an engine intake manifold;
   - a pneumatic cylinder unit operably engaged with said throttle valve by means of a positioning leg;
   - a three-way flow control valve in fluid communication with said pneumatic cylinder unit, said valve having respective input conduits for atmospheric pressure and vacuum, and having means for alternatively transmitting said atmospheric pressure and said vacuum to said pneumatic cylinder unit, at least one of said input conduits being in fluid communication with said pneumatic cylinder unit at all times, said transmitting means including opposing coils and pulse generator having an adjustable pulse duty factor, said coils being connected to push-pull outputs of said pulse generator, the alternative positions of said control valve being determined in accordance with said duty factor, said duty factor being applied to said opposing coils simultaneously;

said three-way flow control valve further includes valve seats for said input conduits and a membrane-like, freely-movable ferromagnetic valve plate having non-magnetic surface layers cooperable with said valve seats; and means for adjusting said pulse duty factor in accordance with engine operating parameters.

2. An idling control according to claim 1, wherein each pulse comprises a large switch current of short duration and a following small holding current.

3. An idling control according to claim 1, wherein said means for adjusting said pulse duty factor includes a comparing circuit for comparing a nominal speed with an actual speed of the engine, and delivering a shifting signal for the pulse duty factor to said pulse generator.

4. An idling control according to claim 3, further including a duty factor adjustment circuit for shifting said pulse duty factor.

5. An idling control according to claim 1, wherein said pneumatic cylinder unit includes a membrane valve and a restoring spring.

6. An idling control according to claim 3, including means for modifying said nominal speed as a function of engine operating parameters.

7. An idling control according to 6, wherein said modifying means includes a modifying circuit, said nominal speed being inputted to said circuit and a modified nominal speed being outputted by said circuit.

8. An idling control according to claim 7, further including a temperature feeler operatively connected to said modifying circuit, said temperature feeler sensing the temperature of said engine and causing said modifying circuit to increase said modified nominal speed when said engine is cold.

9. An idling control according to claim 7, further including delay means for increasing said nominal speed when the actual speed of said engine suddenly decreases, said delay means then gradually decreasing said increased nominal speed and thereby gradually decreasing said actual speed of said engine.

10. An idling control as claimed in claim 9, wherein said delay means includes a differentiating circuit which outputs an increased nominal speed to said modifying circuit.

11. An idling control as claimed in claim 10, wherein said increased nominal speed is calculated by said differentiating circuit directly from an actual engine speed signal.

12. An idling control as claimed in claim 11, wherein said delay means further includes a time function circuit connected to said differentiating circuit, said time function circuit delaying the output of said increased nominal speed from said differentiating circuit to said modifying circuit.

* * * * *